US007047666B2

(12) United States Patent
Hahn et al.

(10) Patent No.: US 7,047,666 B2
(45) Date of Patent: May 23, 2006

(54) CLOTHES DRYER AND METHOD FOR UTILIZING AN ULTRASOUND ATOMIZER

(75) Inventors: Iris Hahn, Neubiberg (DE); Ruth Männer, Oberpframmern (DE); Gabriele Preu, München (DE); Carsten Schuh, Baldham (DE)

(73) Assignee: BSH und Siemeus Hausgeraete GmbH, Munich (DE)

( * ) Notice: Subject to any disclaimer, the term of this patent is extended or adjusted under 35 U.S.C. 154(b) by 0 days.

(21) Appl. No.: 10/744,740

(22) Filed: Dec. 22, 2003

(65) Prior Publication Data

US 2004/0134094 A1 Jul. 15, 2004

(30) Foreign Application Priority Data

Dec. 20, 2002 (DE) ..... 102 60 156

(51) Int. Cl.
*F26B 11/02* (2006.01)

(52) U.S. Cl. ..... 34/499; 34/597; 68/205 R

(58) Field of Classification Search ..... 34/595, 34/600, 605, 606, 381, 499, 516, 597; 68/17 R, 68/19.1, 19.2, 20, 205 R
See application file for complete search history.

(56) References Cited

U.S. PATENT DOCUMENTS

| | | | | |
|---|---|---|---|---|
| 3,601,292 | A * | 8/1971 | Bliss | 68/6 |
| 3,908,904 | A * | 9/1975 | Kerner et al. | 239/4 |
| 3,954,403 | A * | 5/1976 | Ferraro | 8/137 |
| 4,057,907 | A * | 11/1977 | Rapino et al. | 34/261 |
| 4,207,683 | A * | 6/1980 | Horton | 34/60 |
| 4,407,450 | A * | 10/1983 | Chegolya et al. | 239/8 |
| 4,526,808 | A * | 7/1985 | Strohmaier | 427/565 |
| 4,744,228 | A * | 5/1988 | Goldberg | 68/20 |
| 5,042,171 | A * | 8/1991 | Obata et al. | 34/604 |
| 5,072,526 | A * | 12/1991 | Hirota et al. | 34/60 |
| 5,996,247 | A * | 12/1999 | Kuboyama | 34/370 |
| 6,035,563 | A * | 3/2000 | Hoefer et al. | 38/77.1 |
| 6,048,265 | A * | 4/2000 | Apple | 454/157 |
| 6,162,259 | A * | 12/2000 | Williams | 8/137 |
| 6,346,126 | B1 * | 2/2002 | Chao et al. | 8/149.2 |
| 6,528,927 | B1 * | 3/2003 | Schuh et al. | 310/328 |
| 6,564,591 | B1 * | 5/2003 | Noyes et al. | 68/5 C |
| 6,691,536 | B1 * | 2/2004 | Severns et al. | 68/12.27 |
| 6,759,021 | B1 * | 7/2004 | Berthold et al. | 423/235 |
| 2003/0091749 | A1 | 5/2003 | France | |
| 2005/0016010 | A1 * | 1/2005 | Pyo et al. | 34/62 |

FOREIGN PATENT DOCUMENTS

| | | |
|---|---|---|
| DE | 73 41 276 | 2/1978 |
| EP | 0 676 497 B1 | 10/1995 |
| JP | 03 055100 A | 7/1989 |
| WO | WO 00/75413 A1 | 12/2000 |

* cited by examiner

*Primary Examiner*—S. Gravini
(74) *Attorney, Agent, or Firm*—John T. Winburn; Russell W. Warnock; Craig J. Loest

(57) ABSTRACT

A clothes dryer includes at least one clothes drum for receiving textiles and at least one ultrasound atomizer disposed in the dryer for generating an aerosol from a liquid. The invention further relates to a method for introducing an aerosol into the clothes drum of the clothes dryer. A liquid is conducted from a reservoir to an ultrasound atomizer disposed in the clothes dryer, atomized there, and conducted into the clothes drum. The invention relates to further applications for an ultrasound atomizer, such as a washing machine, dishwasher, and/or motor vehicle.

27 Claims, 3 Drawing Sheets

CLOTHES DRYER AND METHOD FOR UTILIZING AN ULTRASOUND ATOMIZER

BACKGROUND OF THE INVENTION

Field of the Invention

The invention relates to a clothes dryer, a method for introducing an aerosol into the drum of a clothes dryer, and further instances of utilization of an ultrasound atomizer.

A known technique for introducing scents into spaces, for instance, the passenger area of a motor vehicle, is to utilize spraying devices in which scents can be introduced into the space by pressure or temperature or by propellants. The disadvantage of such systems is that the dosing of the scent cannot be precisely controlled and, particularly, the droplet size in the mist or vapor cannot be precisely set. Additionally, the use of propellants harms the environment.

In clothes dryers, particularly, household dryers, in certain operating modes it may be necessary to introduce a liquid into the interior of the dryer, where the textiles that are being processed are received. To such an end, devices and methods have been developed by which scents can be introduced into the dryer interior, particularly, into the drum. Cloths or sheets of paper that are impregnated with perfume are placed into the drum together with the textiles that are being processed. The disadvantage of such a method is that the perfumes cannot be precisely dosed. In addition, textiles that are sensitive to moisture can be damaged, namely, stained, as a result of contacting the impregnated sheet.

Another known technique for steaming and deodorizing textiles is to introduce moisture in the form of steam into the interior of a clothes dryer. The disadvantage of such a device, which is described in German Utility Model DE 73 41 276 U1, for example, is the relatively expensive construction that is needed to generate the steam and conduct it into the interior of the device. In these devices, the steam is generated in a vaporizer that includes a heating coil and conducted into the space in which the textiles are received through tubing and piping by way of valves.

SUMMARY OF THE INVENTION

It is accordingly an object of the invention to provide a clothes dryer and utilization of an ultrasound atomizer that overcome the hereinafore-mentioned disadvantages of the heretofore-known devices and methods of this general type and that provides suitable measures allowing the introduction of perfume solutions into a space whereby the supply of the perfume solution can be precisely controlled and precisely dosed. Furthermore, these measures should be versatile and have a simple construction. In particular, the aim is to provide suitable measures for a clothes dryer by which liquids such as perfume solutions or water can be introduced into the dryer interior, particularly, into the drum, without damaging the textiles. These measures should be easy to integrate into the dryer and should allow a precise dosing of the liquids.

With the foregoing and other objects in view, there is provided, in accordance with the invention, a clothes dryer, including a housing, at least one clothes drum disposed in the housing for receiving textiles, and at least one ultrasound atomizer disposed in the housing for generating an aerosol from a liquid.

The invention is based on the recognition that the liquid can be introduced into the space in the form of a fine aerosol. In particular, the inventors have discovered that this can be, ideally, achieved by utilizing an ultrasound atomizer, for instance, an ultrasound atomizer marketed by Siemens AG, for generating the aerosol.

With the ultrasound atomizer, a dispersed aerosol can be created from the liquid and, subsequently, introduced into the clothes drum. In contrast to the known types of atomization, this type of atomization is good for the environment; furthermore, it does not require a complex construction. The utilization of an ultrasound atomizer to introduce a liquid into a clothes dryer is advantageous specifically because a small droplet size can be achieved with this kind of atomization. The inventive clothes dryer can, therefore, be utilized with exceptionally good results for odor removal by steam extraction, whereby the generating of a highly dispersed water mist at the ultrasound atomizer can accelerate the scenting of the mist in the drum and so prevent wetting of the textiles. When the textiles are processed with perfume or cleaning solvents, damage, for instance, from intensive contact with perfumes, can be avoided by the small droplet size that is possible in the inventive dryer. Lastly, the ultrasound atomizer in the inventive clothes dryer can also be utilized for removing condensate that overflows a condensate collector and must be removed.

The inventive clothes dryer has the further advantage of a simple construction, and the inventively utilized ultrasound atomizer can have a small size. This characteristic of the ultrasound atomizer is particularly important for utilization in a clothes dryer. In clothes dryers, components such as heaters, control devices, regulators and other must be housed inside the dryer beside the clothes drum. For this limited space, the inventive utilization of an ultrasound atomizer, with the small dimensions that can be realized therewith, is particularly advantageous. Because of the simple construction and small size, it is also possible to easily convert clothes dryers of all kinds into inventive dryers.

In accordance with another feature of the invention, the ultrasound atomizer advantageously represents a piezoelectric, preferably, piezoceramic, ultrasound atomizer. This type of ultrasound atomizer has the advantage that the kinds of liquid that can be introduced into the dryer by this atomizer are not limited to aqueous solutions. Rather, organic solutions can also be atomized with the piezoceramic ultrasound atomizer. For instance, alcohol based or oil based perfume solutions can be used. Furthermore, the power of the ultrasound atomizer can be freely controlled so that the amount of liquid that is atomized can be set between 0 and 100%. This is beneficial to utilization in a clothes dryer, in particular, because the required amount of moisture in the clothes drum is dependent on factors such as load level, drying temperature, and so on, and, therefore, it must be adjusted accordingly. Furthermore, the aerosol that is generated by a piezoceramic ultrasound atomizer exhibits a homogenous droplet size distribution. This homogenous distribution can be used in a clothes dryer for the uniform wetting or treatment of the textiles. The droplet size can also be purposefully controlled if a piezoceramic ultrasound atomizer is utilized. Lastly, if this type of ultrasound atomizer is used, the amount of energy that is required for atomizing the liquid is small. Thus, the inventively utilized ultrasound atomizer is superior to pressure jet atomizers or vaporizers from an economic standpoint as well.

In accordance with a further feature of the invention, the inventive clothes dryer represents a condenser type clothes dryer. The utilization of an ultrasound atomizer is particularly important in this type of dryer because the processing air is circulated and, therefore, it is desirable to give the textiles a fresh scent by introducing perfumes. The use of the condensation for ventilating textiles, for example, can also be accomplished in the inventive clothes dryer easily and reliably by the ultrasound atomizer.

In accordance with an added feature of the invention, the ultrasound atomizer is, advantageously, connected to a liquid reservoir. In combination machines having both a washer and a dryer, the ultrasound atomizer can be connected directly—that is to say, by way of a dosing device—to the water supply line leading to the machine and can be supplied with liquid over the line. Providing a liquid reservoir can increase the versatility the clothes dryer. Thus, the liquid reservoir can, alternatively, represent a condensation collection container or a liquid reservoir for other liquids, for instance, perfume solutions. Particularly in the latter case, the liquid reservoir is formed by a cartridge system.

The advantage of using cartridges is that individual cartridges can be filled with different perfume solutions. The scent that is dispersed in the space changes depending on which cartridge is used, that is to say, actuated. It is, thus, easy to introduce a different scent into the textiles from one drying cycle to the next.

In accordance with an additional feature of the invention, the liquid reservoir is a condensation collection container, a perfume solution liquid reservoir, and/or a cartridge system with at least one removable cartridge.

With the objects of the invention in view, there is also provided a method for introducing an aerosol, including the steps of disposing an ultrasound atomizer at a dryer having a clothes drum, conducting a liquid from a reservoir to the ultrasound atomizer, atomizing the liquid at the ultrasound atomizer, and conducting the atomized liquid into the clothes drum. The conduction of the aerosol that is generated at the ultrasound atomizer can be accomplished by a separate fan, by the fan that moves the processing air in the dryer, or by the ultrasound atomizer itself.

In accordance with yet another mode of the invention, the liquid can be conducted to the ultrasound atomizer and atomized there on a permanent basis during the drying operation of the clothes dryer. With such a development of the method, moisture or perfumes can be supplied during the entire drying process undergone by the clothes.

In accordance with yet a further mode of the invention, alternatively or additionally, the liquid can be conducted to the ultrasound atomizer and atomized there at specified times, preferably, near the end of the drying operation. Such an embodiment is advantageous particularly in the introduction of perfumes. Shortly before the end of the drying operation, the desired scent can be introduced into the clothes so that the scent is still fresh when the clothes are removed. The times at which the liquid is conducted to the ultrasound atomizer can be defined by the program for operating the dryer or set manually by the user of the dryer.

With the objects of the invention in view, there is also provided a method for atomizing a solution, including the steps of providing an ultrasound atomizer and atomizing at least one perfume solution with the ultrasound atomizer.

The goals of the invention are further achieved by utilization of an ultrasound atomizer for atomizing perfume solutions. In particular, the perfume solutions can be inventively atomized in the interior of a washing machine, dishwasher, or motor vehicle passenger area. In these applications, the fine dispersion of drops of the perfume that can be achieved by the ultrasound atomizer is particularly advantageous because damage and intense odor in objects such as textiles, dishes, or seats can be avoided.

The advantages and features that have been described for the clothes dryer and the ultrasound atomizer that is utilized therein also apply to the additional applications of the ultrasound atomizer and the method, and vice-versa.

Other features that are considered as characteristic for the invention are set forth in the appended claims.

Although the invention is illustrated and described herein as embodied in a clothes dryer and utilization of an ultrasound atomizer, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
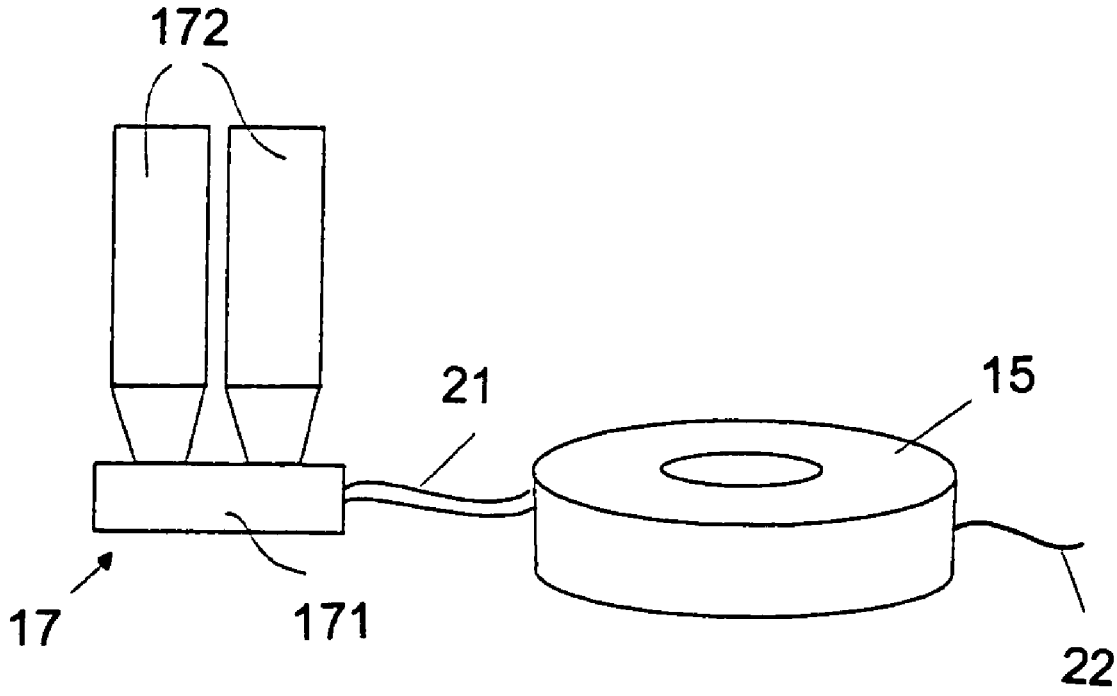
FIG. 1 is a diagrammatic, partially elevational and partially perspective view of an ultrasound atomizer with a liquid reservoir for instances of utilization according to the invention.

Referring now to the figures of the drawings in detail and first, particularly to FIG. 1 thereof, there is shown a schematic representation of an ultrasound atomizer 15 connected to a reservoir 17. In the embodiment, the reservoir 17 is a cartridge system and includes a receptacle unit 171 containing two cartridges 172. The receptacle unit 171 can also be configured for receiving only one cartridge or more than two cartridges. A hose forms the connection 21 between the receptacle unit 117 and the ultrasound atomizer 15. The dosing of the amount of liquid to be supplied to the ultrasound atomizer 15 can be accomplished by the receptacle unit 171 or a non-illustrated dosing unit that is disposed in connection 21, for example, a valve. The voltage required for atomizing the liquid, namely for activating the ultrasound atomizer 15, is conducted to the ultrasound atomizer 15 over a line 22. The line 22 can be connected to an accumulator, a battery, or the like.

Figure 2:
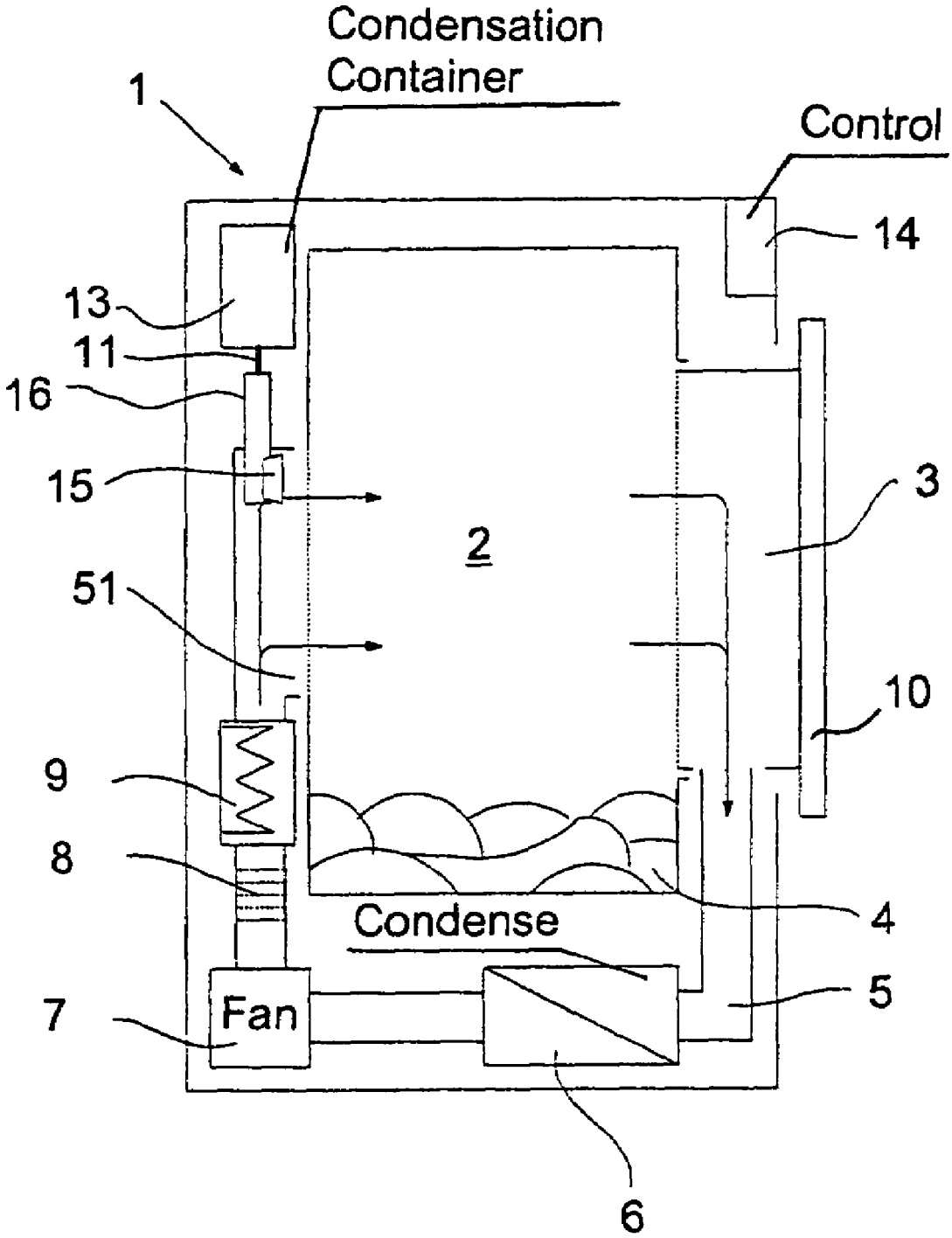
FIG. 2 is a diagrammatic, cross-sectional view of a first embodiment of a clothes dryer according to the invention.

FIG. 2 represents an embodiment of the inventive clothes dryer 1. The dryer 1 is a condenser dryer in this case. Provided in the dryer 1 is a rotating drum 2, which serves for receiving textiles, particularly, articles of clothing 4, and which can be loaded through an opening 3 in the front side of the dryer 1 that can be sealed by a door 10. Indicated in the lower region of the dryer 1 is a condenser 6, which is disposed in a processing air channel 5. Connected to the condenser 6 on the downstream side of the processing air channel 5 is a fan 7, followed by an odor filter 8. Behind the odor filter 8 in the processing air channel 5 is a processing air heater 9. On the front side of the dryer 1 is a control and regulating unit 14.

From the processing air heater 9, the processing air channel 5 leads to an exit opening 51 of the channel 5, which opens into the clothes drum 2. The exit opening 51, advantageously, has a larger cross-section than the channel 5 so that the processing air can be conducted into the drum 2 uniformly.

In the upper region of the dryer 1 is a condensation collection container 13, which is connected, over a water line 11, to a dosing unit 16 that interacts with an ultrasound atomizer 15. The atomizer 15 is disposed in the upper region of the exit opening 51 of the processing air channel 5.

If the clothes dryer is utilized for ventilation, for example, a defined portion of the condensation that settles in the condensation collection container 13 can be supplied to the atomizer 15 by the dosing device 16. An ultra-fine mist is generated at the ultrasound atomizer 15 from the condensation. The fine mist is conducted through the processing air that flows along the atomizer 15, mixed with it, and conducted into the drum 2. At the same time, the processing air heater 9 continuously heats the processing air that penetrates the drum 2. The ultra-fine mist is, thus, evaporated in the drum 2, and textiles 4 that are moved in the drum 2 can be treated by the vapor so generated.

Figure 3:
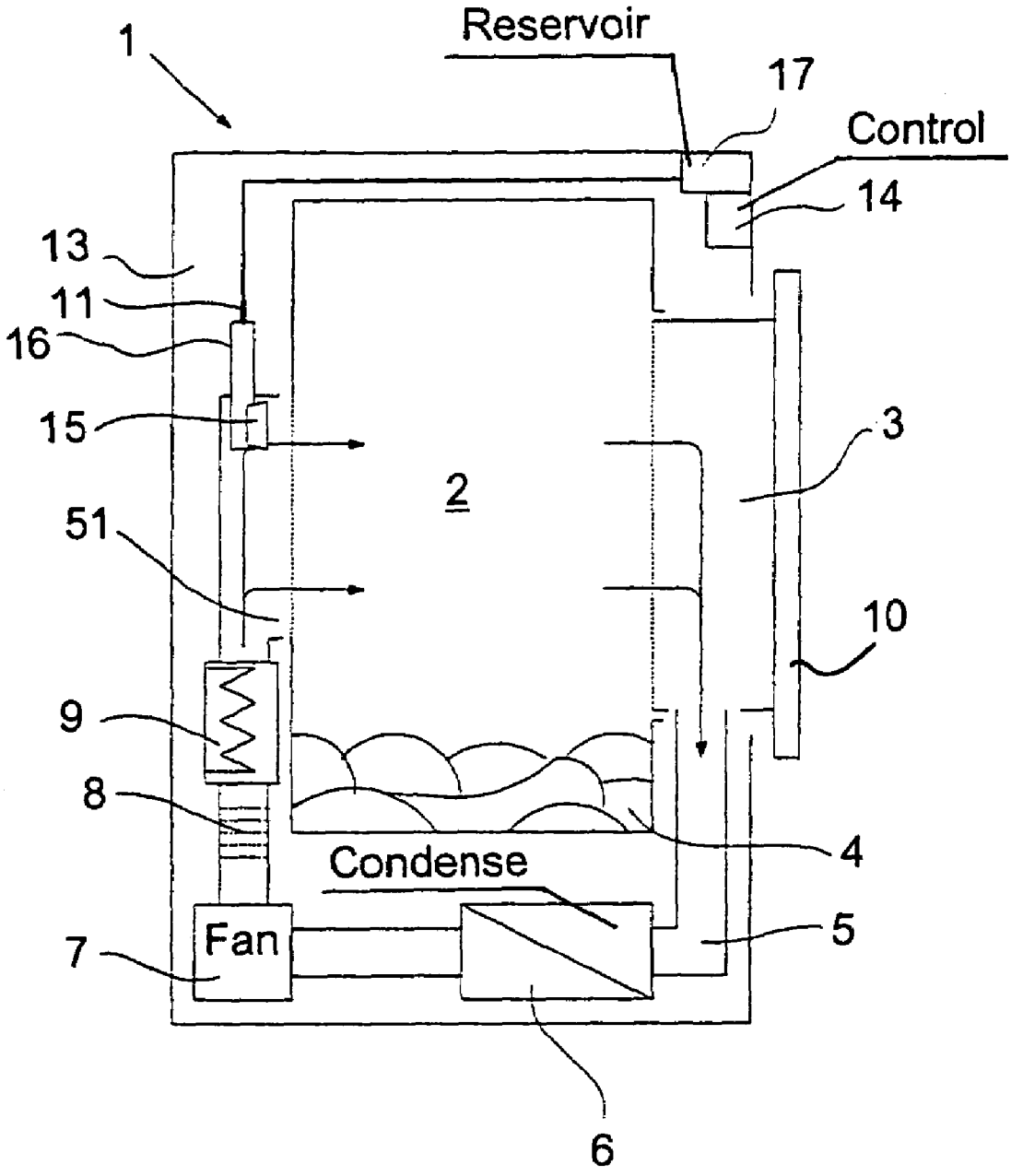
FIG. 3 is a diagrammatic, cross-sectional view of a second embodiment of a clothes dryer according to the invention.

FIG. 3 represents another embodiment of the inventive clothes dryer 1. The dryer 1 has substantially the same construction as in FIG. 2. But in this embodiment, the ultrasound atomizer 15 is connected by way of the dosing device 16 to a reservoir 17 that is disposed in the front region of the dryer 1. The reservoir 17 is disposed in the upper region, i.e., above the input opening 3 of the dryer 1 behind a non-illustrated panel. So positioned, the reservoir 17 is accessible from outside.

The user of the dryer 1 can remove the reservoir 17 and fill it or can fill it in the mounted condition. The reservoir 17 can also represent a cartridge system as described in connection with FIG. 1. Such a embodiment is particularly suitable for the introduction of different perfumes into the drum 2 for different drying operations.

The present invention is not limited to the represented embodiments. For example, the reservoir can be combined with the ultrasound atomizer in one housing. This facilitates the mounting of the ultrasound atomizer in a clothes dryer, for example.

The cartridges that are utilized as reservoirs can be constructed in the form of cartridges that are sealed for transport and opened either prior to or during insertion into the receptacle unit. The liquid contained in the cartridge can, thus, enter the receptacle unit, from where it can be delivered to the ultrasound atomizer by dosing units as needed. The receptacle unit can also be constructed to serve for dosing the perfume solution itself. In cartridge systems in which the receptacle unit holds more than one cartridge, the receptacle unit can also serve for controlling one or more cartridges. The size of the reservoir or the cartridges is selected such that they do not need to be refilled or replaced for long periods.

Similarly, the mounting location of the ultrasound atomizer and the reservoir in a dryer is not limited to the variants represented here. The ultrasound atomizer can also be disposed near the loading opening 3 of the dryer, for example.

The invention, particularly, the utilizing of an ultrasound atomizer in a clothes dryer, creates the possibility of dosing liquids such as perfumes or water by simple measures, without the user of the dryer having to use supplemental measures such as sheets. In addition, the ability to purposefully vary the amount of perfume or water is created advantageously; that is, the user of a dryer can have the clothes more or less scented or steamed as desired. Lastly, the inventive clothes dryer has a simple construction, and it is possible to convert conventional clothes dryers into an inventive dryer by minor constructional measures.

We claim:

1. A clothes dryer, comprising:

a housing;

at least one clothes drum disposed in said housing for receiving textiles; and at least one ultrasound atomizer disposed in said housing for generating an aerosol from a liquid.

2. The clothes dryer according to claim 1, wherein said ultrasound atomizer is a piezoelectric ultrasound atomizer.

3. The clothes dryer according to claim 1, wherein said ultrasound atomizer is a piezoceramic ultrasound atomizer.

4. The clothes dryer according to claim 1, wherein the dryer is a condenser dryer.

5. The clothes dryer according to claim 1, further comprising a condenser fluidically connected to said drum.

6. The clothes dryer according to claim 1, further comprising a liquid reservoir fluidically connected to said ultrasound atomizer.

7. The clothes dryer according to claim 6, wherein said liquid reservoir is a condensation collection container.

8. The clothes dryer according to claim 6, wherein said liquid reservoir is a perfume solution liquid reservoir.

9. The clothes dryer according to claim 6, wherein said liquid reservoir is a cartridge system including at least one removable cartridge.

10. The clothes dryer according to claim 6, wherein said liquid reservoir is at least one removable cartridge.

11. The clothes dryer according to claim 7, wherein said liquid reservoir is at least one removable cartridge.

12. The clothes dryer according to claim 8, wherein said liquid reservoir is at least one removable cartridge.

13. A method for introducing an aerosol, which comprises:

disposing an ultrasound atomizer at a dryer having a clothes drum;

conducting a liquid from a reservoir to the ultrasound atomizer;

atomizing the liquid at the ultrasound atomizer; and conducting the atomized liquid into the clothes drum.

14. The method according to claim 13, which further comprises:

conducting the liquid to the ultrasound atomizer; and atomizing the liquid at the ultrasound atomizer during a drying operation of the dryer.

15. The method according to claim 13, which further comprises:

conducting the liquid to the ultrasound atomizer; and continually atomizing the liquid at the ultrasound atomizer during a drying operation of the dryer.

16. The method according to claim 13, which further comprises:

conducting the liquid to the ultrasound atomizer; and atomizing the liquid at the ultrasound atomizer during a drying operation of the dryer on a permanent basis.

17. The method according to claim 13, which further comprises conducting the liquid to the ultrasound atomizer and atomizing the liquid at the ultrasound atomizer at defined times.

18. The method according to claim 13, which further comprises conducting the liquid to the ultrasound atomizer and atomizing the liquid at the ultrasound atomizer near an end of a drying operation of the dryer.

19. A clothes dryer comprising:

a housing;

a drum disposed within the housing and mounted for rotation with respect to the housing;

an air heater for heating air;

at least one opening in fluid flow communication with the drum, the drum receiving heated air from the air heater through the at least one opening; and an ultrasound atomizer having a vibrational element for selectively atomizing a liquid and generating an aerosol discharge, the ultrasound atomizer being in fluid flow communication with the drum and the drum receiving the aerosol from the ultrasound atomizer.

20. The clothes dryer according to claim 19, wherein the ultrasound atomizer includes a piezoelectric ultrasound atomizer.

21. The clothes dryer according to claim 19, wherein the liquid includes a perfume solution.

22. The clothes dryer according to claim 19, further comprising a removable cartridge retaining the liquid and being removably connected to the ultrasound atomizer in fluid flow communication with the ultrasound atomizer.

23. A clothes dryer comprising:

a housing defining an opening and a door connected to the housing for closing the opening;

a drum disposed within the housing and mounted for rotation with respect to the housing and receiving textiles through the opening;

a reservoir disposed within the housing and retaining a liquid;

a conduit connected to the reservoir and directing fluid flow of the liquid from the reservoir; and an ultrasound atomizer connected to the conduit and receiving the liquid from the reservoir, the ultrasound atomizer atomizing the liquid and generating an aerosol discharge, the ultrasound atomizer being in fluid flow communication with the drum and the drum receiving the aerosol from the ultrasound atomizer.

24. The clothes dryer according to claim 23, wherein the reservoir includes a receptacle unit and a removable cartridge retaining the liquid and being removably connected to the receptacle unit and providing the liquid to the ultrasound atomizer.

25. The clothes dryer according to claim 24, further comprising two removable cartridges retaining the liquid and being removably connected to the receptacle unit.

26. The clothes dryer according to claim 23, further comprising a dosing device connected to the conduit between the reservoir and the ultrasound atomizer and providing a defined portion of the liquid to the ultrasound atomizer.

27. The clothes dryer according to claim 23, wherein the ultrasound atomizer includes a piezoelectric ultrasound atomizer.

* * * * *

UNITED STATES PATENT AND TRADEMARK OFFICE

CERTIFICATE OF CORRECTION

PATENT NO. : 7,047,666 B2
APPLICATION NO. : 10/744740
DATED : May 23, 2006
INVENTOR(S) : Iris Hahn et al.

It is certified that error appears in the above-identified patent and that said Letters Patent is hereby corrected as shown below:

On title page
Item (73), should read: Assignee: BSH Bosch und Siemens Hausgeraete GmbH, Munich, (DE)

Signed and Sealed this

Eleventh Day of December, 2007

JON W. DUDAS
*Director of the United States Patent and Trademark Office*